US011680734B2

(12) United States Patent
Tully et al.

(10) Patent No.: US 11,680,734 B2
(45) Date of Patent: Jun. 20, 2023

(54) PORTABLE INSULATED THERMO-ELECTRIC COOLER AND DISPENSER

(71) Applicants: Gwyn-Mohr Pierce Tully, Sacramento, CA (US); Gregory Edward Young, Sacramento, CA (US); Michael Peter Kelley, Paso Robles, CA (US)

(72) Inventors: Gwyn-Mohr Pierce Tully, Sacramento, CA (US); Gregory Edward Young, Sacramento, CA (US); Michael Peter Kelley, Paso Robles, CA (US)

( * ) Notice: Subject to any disclaimer, the term of this patent is extended or adjusted under 35 U.S.C. 154(b) by 0 days.

(21) Appl. No.: 17/235,644

(22) Filed: Apr. 20, 2021

(65) Prior Publication Data

US 2022/0065501 A1 Mar. 3, 2022

Related U.S. Application Data

(63) Continuation of application No. 14/982,732, filed on Dec. 29, 2015, now abandoned, which is a continuation-in-part of application No. 14/205,325, filed on Mar. 11, 2014, now abandoned.

(60) Provisional application No. 61/780,568, filed on Mar. 13, 2013.

(51) Int. Cl.
*F25B 21/02* (2006.01)

(52) U.S. Cl.
CPC ..... *F25B 21/02* (2013.01)

(58) Field of Classification Search
CPC ..... F25B 21/02; B67D 2210/00031; B67D 1/0869; F25D 31/006
See application file for complete search history.

(56) References Cited

U.S. PATENT DOCUMENTS

| | | | |
|---|---|---|---|
| 4,006,606 | A | 2/1977 | Underdue |
| 4,164,851 | A | 8/1979 | Bryant |
| 4,164,853 | A | 8/1979 | McDonough |
| 4,225,059 | A | 9/1980 | Kappos |
| 4,633,678 | A | 1/1987 | Lea et al. |
| 4,802,344 | A | 2/1989 | Livingston et al. |
| 4,891,949 | A | 1/1990 | Caldarola |
| 5,021,280 | A | 6/1991 | Farnworth et al. |
| 5,247,798 | A | 9/1993 | Collard, Jr. |
| 5,282,561 | A | 2/1994 | Mihalich |
| 5,398,355 | A | 3/1995 | Bailey |
| 5,537,825 | A | 7/1996 | Ward |
| 5,572,872 | A | 11/1996 | Hlavacek |
| 5,584,188 | A | 12/1996 | Tippmann et al. |

(Continued)

FOREIGN PATENT DOCUMENTS

EP 1756495 A1 2/2007

OTHER PUBLICATIONS

U.S. Appl. No. 14/982,732, Portable Insulated Thermo-Electric Cooler and Dispenser, Dec. 29, 2015.

(Continued)

*Primary Examiner* — Ana M Vazquez
(74) *Attorney, Agent, or Firm* — Goodwin Procter LLP

(57) ABSTRACT

A Cornelius keg refrigerated storage, transport, and contents dispensing device holds the keg in the interior of a container equipped with provision for transporting the container, cooling the keg using refrigerated contact along the effective height of the keg, insulating the keg to maintain temperature, and storing the equipment for dispensing the keg contents.

20 Claims, 11 Drawing Sheets

(56) References Cited

U.S. PATENT DOCUMENTS

| | | | | |
|---|---|---|---|---|
| 5,845,501 | A | 12/1998 | Stonehouse et al. | |
| 6,658,857 | B1 | 12/2003 | George | |
| 7,089,749 | B1 | 8/2006 | Schafer | |
| 7,735,334 | B2 | 6/2010 | Johnson | |
| 7,757,908 | B1 | 7/2010 | Buhl, Jr. | |
| 7,861,538 | B2 | 1/2011 | Welle et al. | |
| 8,241,918 | B2 | 8/2012 | Zeitler et al. | |
| 9,815,677 | B2 * | 11/2017 | Lassen | B67D 1/0841 |
| 2006/0131325 | A1 | 6/2006 | Wauters et al. | |
| 2006/0138177 | A1 | 6/2006 | Wauters et al. | |
| 2006/0150637 | A1 * | 7/2006 | Wauters | F25D 31/006 62/3.64 |
| 2006/0248902 | A1 | 11/2006 | Hunnell | |
| 2008/0022696 | A1 | 1/2008 | Welle et al. | |
| 2008/0236175 | A1 | 10/2008 | Chaparro Monferrer et al. | |
| 2009/0038317 | A1 | 2/2009 | Otey | |
| 2009/0158770 | A1 | 6/2009 | Cohrs et al. | |
| 2009/0266101 | A1 | 10/2009 | Sloot et al. | |
| 2009/0277187 | A1 | 11/2009 | McGann | |
| 2011/0243696 | A1 | 10/2011 | DiBenedetto | |
| 2013/0291557 | A1 | 11/2013 | Edwards et al. | |
| 2013/0327793 | A1 | 12/2013 | Monzel | |

OTHER PUBLICATIONS

U.S. Appl. No. 14/205,325, Portable Insulated Thermo-Electric Cooler and Dispenser, Mar. 11, 2014.

Internet website http://www.amazon.com/Dallas-Cowboys-Portable-Party-Refrigeralor/dp/B001 EAYYSO/ref=sr_ 1_ 1?e=UTFB&qid=1394493983&sr=8-1 &keywords=portable+party+refrigeralor, Dale unknown.

Internet website http://www.amazon.com/Noslalgia-Electrics-KRS2100-Kegoralor-Fridge/dp/BOOOHJVYDQ. unknown.

Internet website http://www.inslruclables.com/id/Portable-Keg-Cooler-aka-R2-Beer2/. Dale unknown.

* cited by examiner

PORTABLE INSULATED THERMO-ELECTRIC COOLER AND DISPENSER

CROSS-REFERENCE TO RELATED APPLICATIONS

This application is a continuation of U.S. patent application Ser. No. 14/982,732 filed on Dec. 29, 2015, which is a continuation-in-part of U.S. patent application Ser. No. 14/205,325 filed on Mar. 11, 2014 which claims the benefit of U.S. Provisional Patent Application No. 61/780,568 filed on Mar. 13, 2013, which are incorporated herein by reference in their entireties.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

Field of the Invention

The portable insulated thermo-electric cooler and dispenser invention relates to a multi-functional device providing the functions of supporting, insulating, cooling, and dispensing a liquid contained in a metal pressure vessel, such as a Cornelius keg.

Description of Related Art

Beer drinkers often buy and home beer brewers often prepare beer in a stainless steel or aluminum keg in a size that was originally standardized for soda vending. These kegs are called a Cornelius keg, or are sometimes referred to as a Corny keg or soda keg, or for commercially brewed beer a similar size is the sixth barrel keg. The benefits to using a keg include cost, quality maintenance of the contents, and the convenient size. Kegs make it easier to enjoy craft beer with no bottles to deal with, no recycling deposit, and for commercially brewed beer, guaranteed refund for the empty keg. Draft beer is generally better tasting than beer in the bottle, and maintains its quality up to 30 days once tapped with CO2. The 5 gal size means "a couple pints after work" can finish the keg before it starts to go bad and it is a perfect amount for a small party (about 40 pints or 53 bottles per keg).

The popular size keg holds a nominal 5 gallons and typically comes in two similar sizes. One size, which is sometimes called a Coke® keg is 23 inches high and 9 inches in diameter. This size typically has quick disconnect fittings on the inlet and outlet ports at the upper end employing a pin-lock design. On the pin-lock design there are several metal posts (pins) dispersed horizontally around the port inside diameter. These pins guide grooves in the connector to a position that seals and locks it on the port. The "gas-in" port usually has two pins and the "liquid-out" port typically has three so it is impossible to accidentally connect the carbon dioxide supply to the liquid outlet. The other size is called a Pepsi® keg and is 25 inches high and 8½ inches in diameter. This size typically has ball-lock quick disconnect fittings on the inlet and outlet ports on the upper end. These ports have bayonet grooves in the port inside diameter that guide ball bearings in the connectors to a position that seals and locks it on the port. The keg inlet port opens directly to the upper area of the keg while the outlet port is attached to a tube that runs to near the bottom of the keg to allow dispensing essentially all of the contents. The Coke® keg locates the tube near the side of the keg while the Pepsi® keg locates it near the centerline. Both types of kegs have a removable cap on the upper end in addition to the ports that is large enough to allow cleaning the keg. The cap contains a pressure relief valve, and is positioned on the keg cap opening by a folding locking mechanism that tensions the cap against a resilient cap seal. The Pepsi® keg relief valve also functions as a manual pressure release valve. The pressure is relieved on the Coke® keg by depressing the "gas in" fitting poppet with a tool, such as a screwdriver. Both types of keg have base and top plastic fittings, the base fitting providing a surface for the keg to stand on end and the top fitting containing handle openings for lifting the keg. Other sizes of Corny keg are also available such as 2⅓, 3, and 10 gallon. Each size typically has a base fitting on the lower portion of the keg that provides a flat surface to hold the keg upright, and a handle fitting on the upper portion of the keg which provides a comfortable means for lifting the keg.

The commercial "sixth-barrel" keg, also called a torpedo keg, or sometimes referred to as a corny keg, is 23⅜ inches tall with a diameter of 9¼ inches with a net capacity of 5.16 gallons. This commercial keg uses a standard beer bibcock and pressurization fitting using a single opening on the top of the keg. It requires specialized equipment to clean and fill the keg that is generally outside the capabilities of home brewers.

A problem exists, however, in the transport and in-situ dispensing of the contents of these kegs. Although it is possible to dispense some or almost all of the content from the keg, depending on the type used, when the long dimension is horizontal, it is problematic, and requires careful orientation of the keg. A better solution is to keep the keg in the vertical position as it was designed to be used. The problem is that portable ice chests or refrigeration units which allow this are not readily available. Even if used, conventional chests or refrigeration units are heavy making them difficult to transport. A light weight device to support, transport, insulate, cool, and dispense the contents of the keg is needed.

SUMMARY OF THE INVENTION

This application uses the term "corny keg" or "Cornelius keg" to refer to any of the kegs described.

The portable insulated thermo-electric cooler, transporter, and dispenser provides support and constraint, is an insulated refrigerated storage, an efficient and attractive contents dispensing apparatus, and a means of transport of a keg. The invention provides a support for a corny keg base on a base member arranged substantially horizontal on a frame configured to support the corny keg, its contents, and the pressurization and dispensing fittings used to dispense the contents. One or more thermoelectric solid state coolers employing the Peltier effect are connected to a metal cooling block configured to conform to the curvature of a corny keg outside surface on one side and a flat surface configured to attach to the thermoelectric coolers on the opposite side. The cooling block contacts the effective height of the corny keg which is the height of the keg between the keg base fitting and handle fitting. This height may be in the range of 12 to 22 inches depending on whether 2⅓, 3, 5 or 10 gallon kegs are accommodated. The thermoelectric coolers have a power supply using 120 volts ac or 12 volts dc and a controller that includes a keg temperature sensor. The heated surfaces of the thermoelectric coolers are provided with heat sink to dissipate the heat. With the refrigeration unit mounted to the frame vertical surface and the corny keg supported on the horizontal base, the corny keg outer surface is kept in contact with the refrigeration unit cooling block by one or more adjustable and releasable hold-down straps. At the top of the frame vertical support is an upper horizontal member arranged to provide support for a dispensing table and also support an exterior covering extending from the upper horizontal member to the horizontal base and enveloping the corny keg and frame. An opening in a protective cover built into the covering exposes the refrigeration unit heat sink. The exterior covering has an internal insulating layer and an external wear layer while the interior surface of the exterior covering contains storage pockets arranged to contain the fittings needed to pressurize and dispense the corny keg contents. A closable access opening in the front of the exterior covering opens to allow access to the interior for manipulating the contents. The upper horizontal member also provides a substantially flat upper surface with an opening arranged for a corny keg outlet bibcock, used to connect to the keg "liquid out" port that dispenses the keg contents. The substantially flat upper surface provides a place to rest glasses in the process of being filled by the keg contents. The frame rests on at least two wheels and one or more feet, or three or more wheels, providing stability on a horizontal surface and portability. A handle may also be provided to enhance the portability.

BRIEF DESCRIPTION OF THE SEVERAL VIEWS OF THE DRAWINGS

A more complete understanding of the present invention can be obtained by considering the detailed description in conjunction with the accompanying drawings, in which.

DETAILED DESCRIPTION OF THE INVENTION

Figure 1:
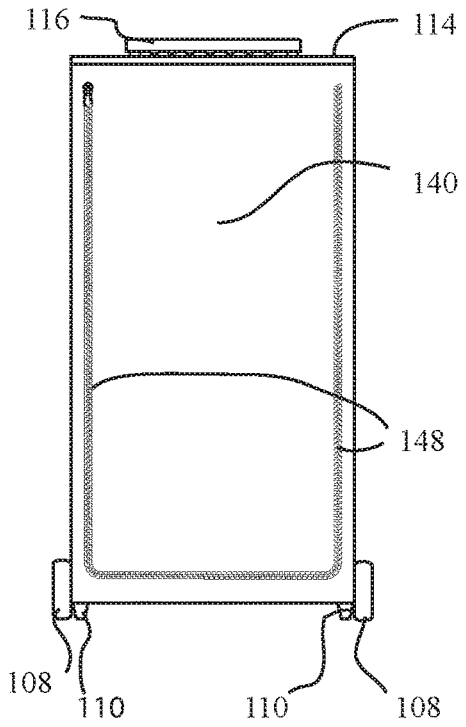
FIG. 1 is a front view of an embodiment of the portable cooler and dispenser showing the exterior.
Figure 2:
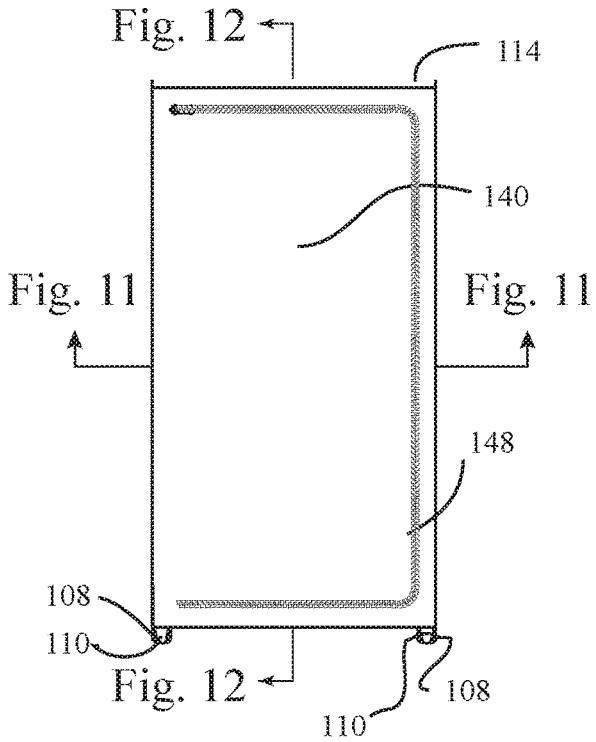
FIG. 2 is a front view of a second embodiment of the portable cooler and dispenser showing the exterior and the location of the cross-sectional views of FIGS. 6 and 7.
Figure 3:
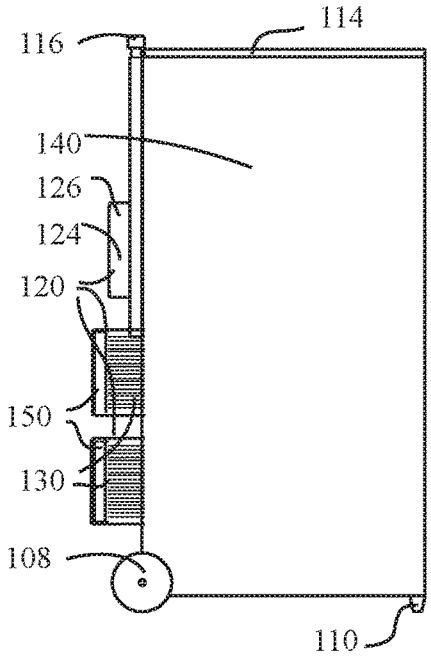
FIG. 3 is a side view of an embodiment of the portable cooler and dispenser showing the exterior.
Figure 4:
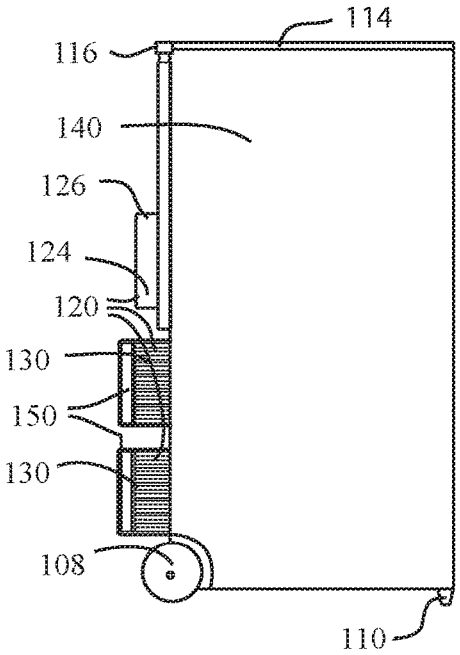
FIG. 4 is a side view of a second embodiment of the portable cooler and dispenser showing the exterior.
Figure 5:
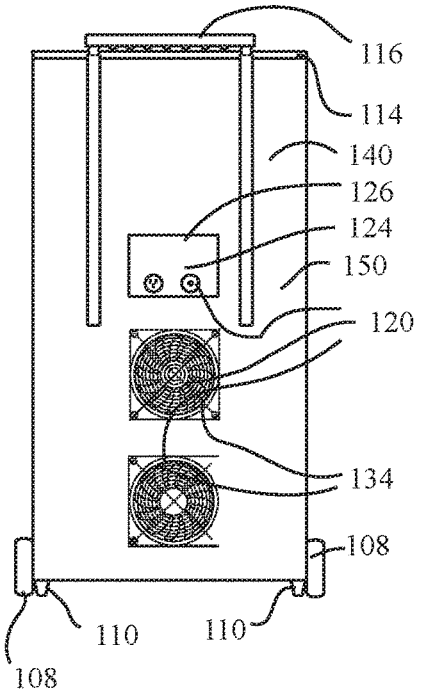
FIG. 5 is a back view of an embodiment of the portable cooler and dispenser showing the exterior.
Figure 6:
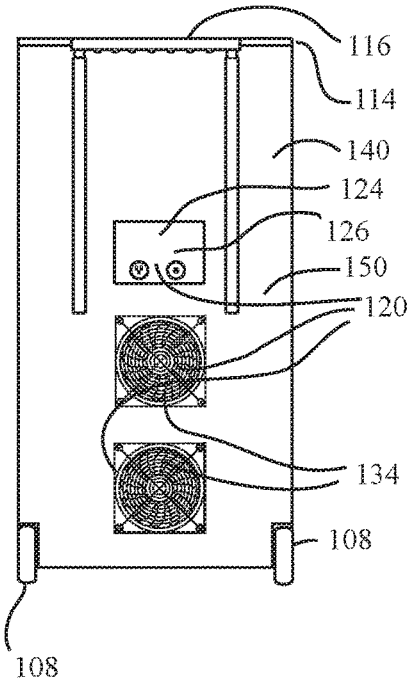
FIG. 6 is a back view of a second embodiment of the portable cooler and dispenser showing the exterior.

The portable insulated thermo-electric cooler and dispenser is a multi-functional device for supporting and constraining a Cornelius keg in a transportable container that is refrigerated and insulated to maintain the keg in a desired temperature range with provision for dispensing the content of the keg while maintaining the keg in the controlled temperature environment. FIGS. 1 through 10 show the exterior configuration of two embodiments of the device. The exterior has a covering (140) of a wear resistant fabric or other suitable material chosen to give a pleasing appearance. An access opening (148) is located on the device front side which provides closable access to the interior of the device. A solid upper surface (114) provides a surface to place items used in the dispensing of the keg contents, such as a glass. This surface contains an opening (118) to provide for installation of a bibcock on the keg. The device transport system includes two wheels (108) two feet (110) and a collapsible handle (116), which makes the system portable. This system allows tilting the device towards the rear to roll it on the wheels and allows it to rest with the upper surface (114) level when supported on the wheels (108) and feet (110). The portions of the refrigeration system (120) visible on the exterior in these embodiments include the heat sink (130) shown on FIGS. 3 and 4 and the fan (134) used to provide air flow through the heat sink for heat removal from the refrigeration unit (120). The exterior of the power supply (124) and control (126) is also visible. Plugs for either a 120 v ac or 12 v dc supply cord are provided with the refrigeration unit (120) power supply input operating on either power source. The power supply may also include rechargeable batteries that provide power for a limited duration. Also visible is a protective cover (150) used to protect the heat sink at top and bottom as shown in FIGS. 3 and 4, 5 and 6, 7 and 8, and 9 and 10.

The interior of the device is shown in cross-section in FIGS. 11 through 14. The keg support system consists of a frame (100) which has a base member (102), a vertical member (104), and an upper horizontal member (106) arranged to enclose the Cornelius keg. The base member (102) supports the Cornelius keg. The vertical member (104) supports the refrigeration unit (120), provides support for one or more hold-down straps (112) which are the means used to anchor the Cornelius keg (50) in the device and to maintain it in a vertical orientation. The vertical orientation means the keg is supported on its bottom while the keg inlet and outlet ports are on the top of the keg to allow installation of a bibcock and pressurization device. The hold-down straps in one embodiment use a quick-release over center latch shown in FIG. 11. The vertical member (104) also supports the protective cover (150) used to protect the refrigeration system exposed parts. The upper horizontal member (106) provides support for the upper surface (114) and is sized so the exterior cover, when supported by the member, encloses the keg. The upper surface (114) may include a bibcock opening (118) that allows inserting the bibcock into the Cornelius keg outlet opening and dispensing the contents into glasses or other containers on the upper surface (114). The frame (100) may be constructed of metal tubing, molded plastic, or other material and construction sufficient for supporting the weights involved.

Figure 7:
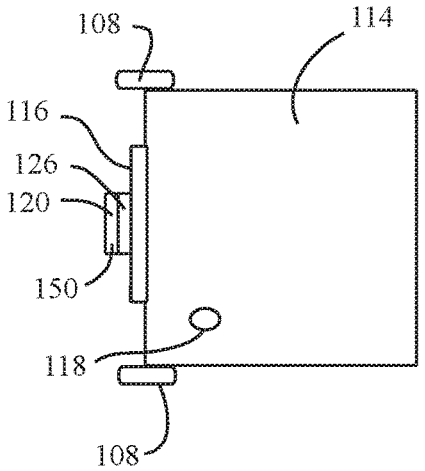
FIG. 7 is a top view of an embodiment of the portable cooler and dispenser showing the exterior.
Figure 8:
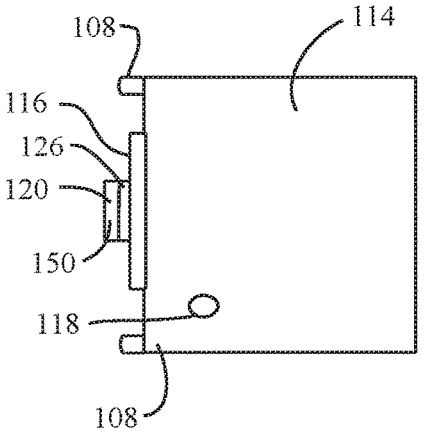
FIG. 8 is a top view of a second embodiment of the portable cooler and dispenser showing the exterior.
Figure 9:
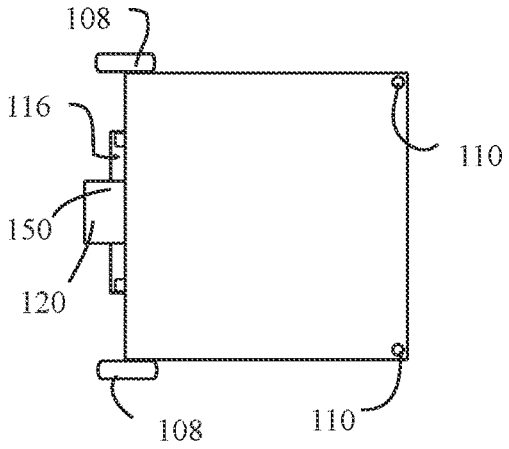
FIG. 9 is a bottom view of an embodiment of the portable cooler and dispenser showing the exterior.
Figure 10:
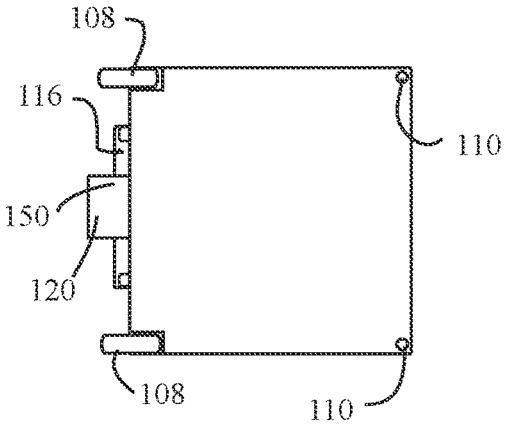
FIG. 10 is a bottom view of a second embodiment of the portable cooler and dispenser showing the exterior.
Figure 11:
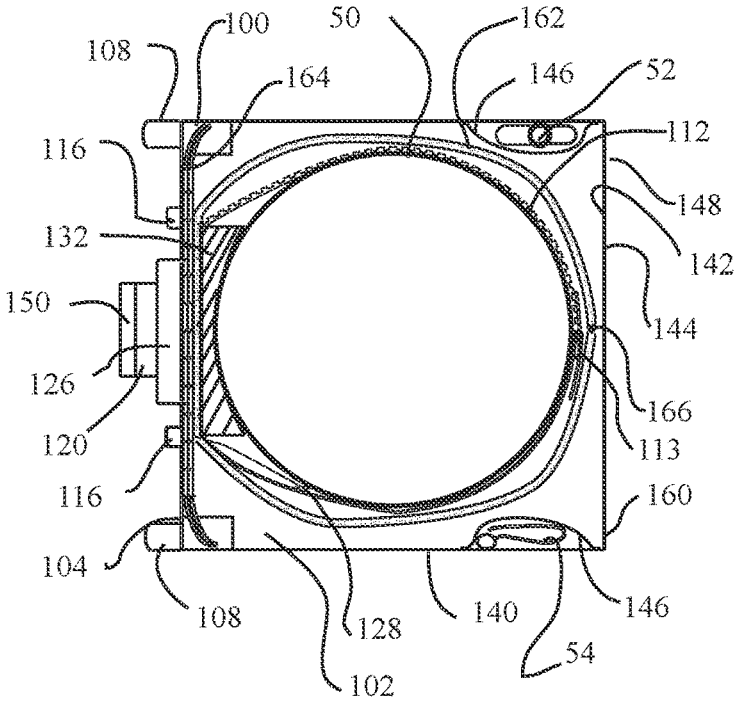
FIG. 11 is a cross-section top view of the portable cooler and dispenser at the location shown on FIG. 2.
Figure 13:
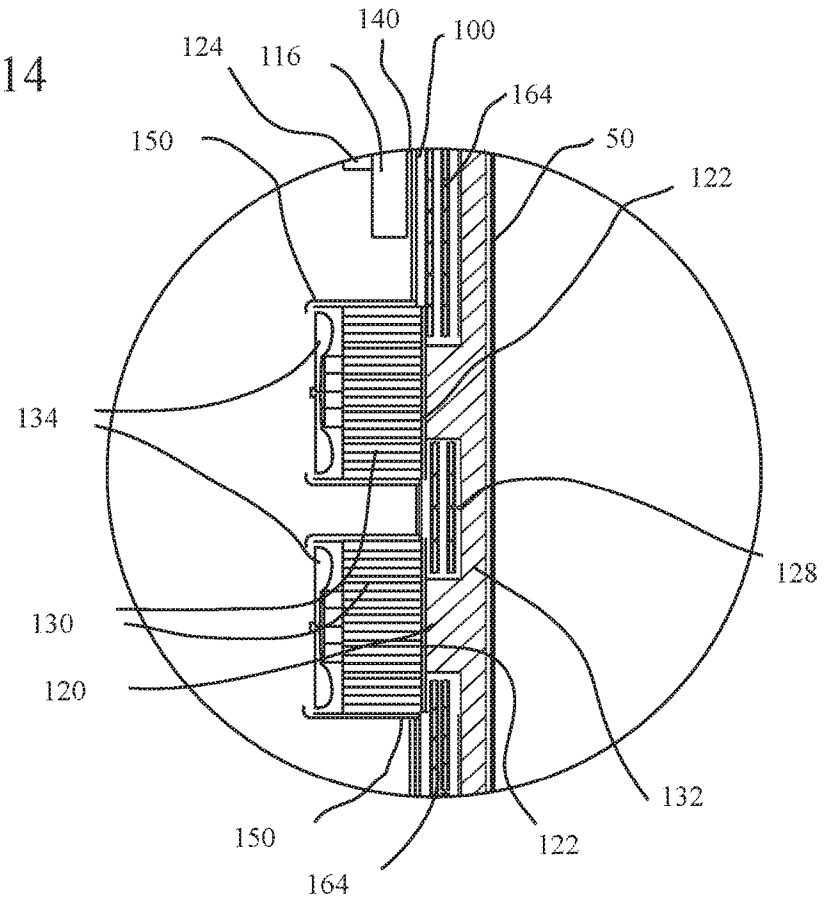
FIG. 13 is an expanded view of the portion of the portable cooler and dispenser at the location shown on FIG. 12.
Figure 12:
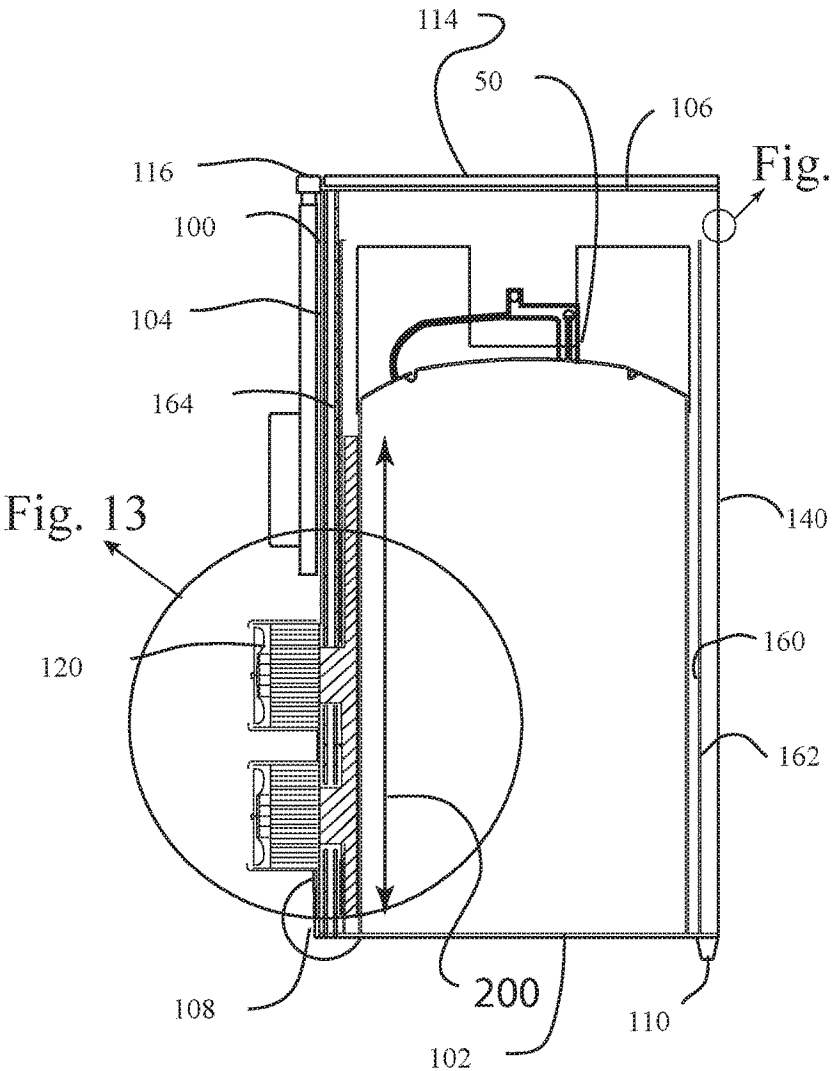
FIG. 12 is a cross-section side view of the portable cooler and dispenser at the location indicated in FIG. 2 showing the location of the expanded views of FIGS. 13 and 14.

The refrigeration system (120) components are shown in FIGS. 11 through 13. These embodiments use two thermoelectric coolers (122) as shown in FIG. 13. The cooler (122) cold side is in contact with a cooling block (132) that is formed of a metal with good thermal conductivity (example aluminum) to be flat on the side contacting the thermoelectric cooler (122) and concave with a radius selected to fit the contour of the Cornelius keg, as shown in FIG. 11, to provide a cool surface in contact with the anchored keg. The contact of the contour with the keg extends from near the top almost to the bottom encompassing the effective height of the keg as shown in FIGS. 7 and 12. The warm side of the thermoelectric cooler (122) is in contact with heat sink (130) that use a fan (134) to provide cooling air flow. A power supply (124) provides power to the thermoelectric cooler as described previous. The power provided is controlled by a temperature sensor connected to the power supply by the wiring shown in FIG. 11. The power supply may also include a digital temperature display and control to adjust the temperature setting. The control may also vary the refrigeration effect to maintain the temperature near the temperature setting by varying the power to the refrigeration unit(s) and/or by stopping power to one or more units. The sensor wiring is routed from the location of the controller (126) to a location on the Cornelius keg (50) outer surface remote from the refrigeration system to obtain a measurement remote from the cooling block (132) as shown in FIG. 11. The temperature sensor (128) is mounted on a hold-down strap (112) in this embodiment for ease of positioning it on the Cornelius keg (50) surface.

Figure 14:
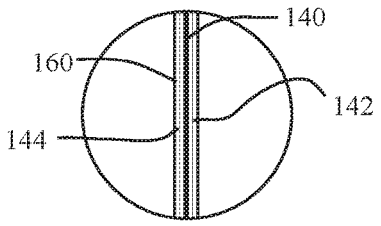
FIG. 14 is an expanded view of the portion of the portable cooler and dispenser at the location shown on FIG. 7

The device cooling system consists of the refrigeration system and insulated storage system components as shown in FIGS. 11 through 13. The insulation in this embodiment has a first insulation member (160), a second insulation member (162), and a third insulation member (164) to retard heat gain from the exterior of the system. The first insulation member (162) is the exterior covering (140) which surrounds the frame sides. This covering has an exterior wear layer (142) and an interior insulating layer (144) as shown in FIG. 14. A wide range of fabrics may be used for the wear layer (142) and the insulating layer (144) may be applied as a coating or as a sheet material attached by bonding or sewing. The second insulation layer (162) is a blanket that encloses the Cornelius keg (50) bottom and outer surfaces. This is a foam fabric (example 6-8 mm closed cell foam neoprene) with a closure (166) (example a zipper) that allows insertion and removal of the Cornelius keg (50) into the second insulation layer (162). The closure (166) is located adjacent the first insulation layer access opening (148), shown in FIG. 1, for ease of installing and removing the Cornelius keg. The third insulation layer (164) is a heat shield installed adjacent the back interior surface of the device between the cooling block (132) and the frame vertical member (104) as shown in FIGS. 11 and 13 to retard heat gain from the refrigeration system (120) warm side. The insulation in this embodiment is two layers of a reflective laminate with the two reflective sheets sandwiching polyethylene bubble film as shown in FIG. 13. The third insulation layer (164) is sized to essentially cover the entire rear interior of the device.

Figure 15:
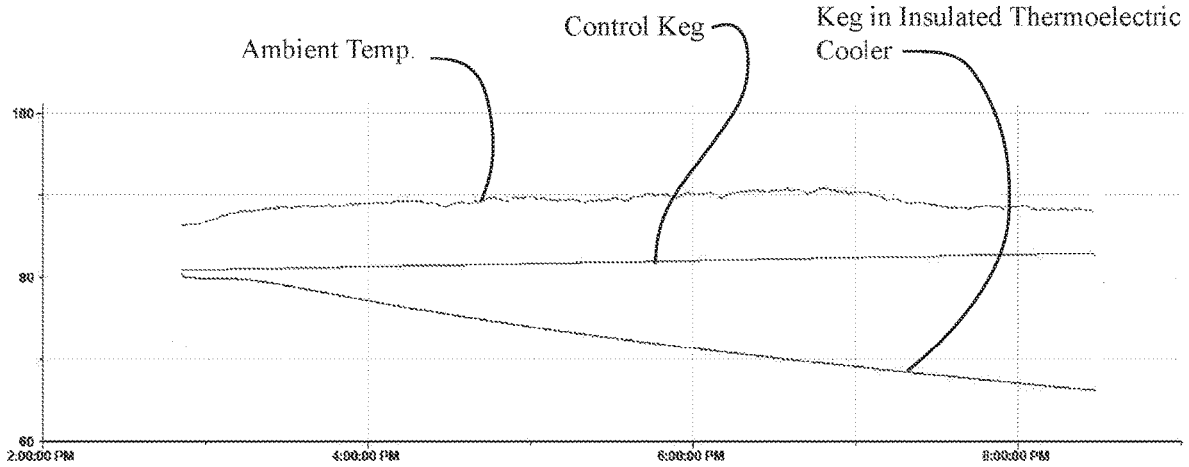
FIG. 15 is a temperature vs time plot showing keg cooling capability of the insulated thermoelectric cooler and dispenser.

Temperature tests on a filled keg in the insulated thermoelectric cooler show the embodiment employing the cooling system consisting of the refrigeration system and insulated storage system described effective in reducing the Cornelius keg (50) temperature in a matter of a few hours from ambient temperature to a desirable chilled temperature, even on warm days. One such test data on a day with the ambient temperature near or above 90 degrees Fahrenheit is shown in FIG. 15. The control keg in FIG. 15 is a filled keg located in ambient temperature conditions. The keg in the insulated thermoelectric cooler is shown to drop over 2.6 degrees Fahrenheit per hour.

Figure 16:
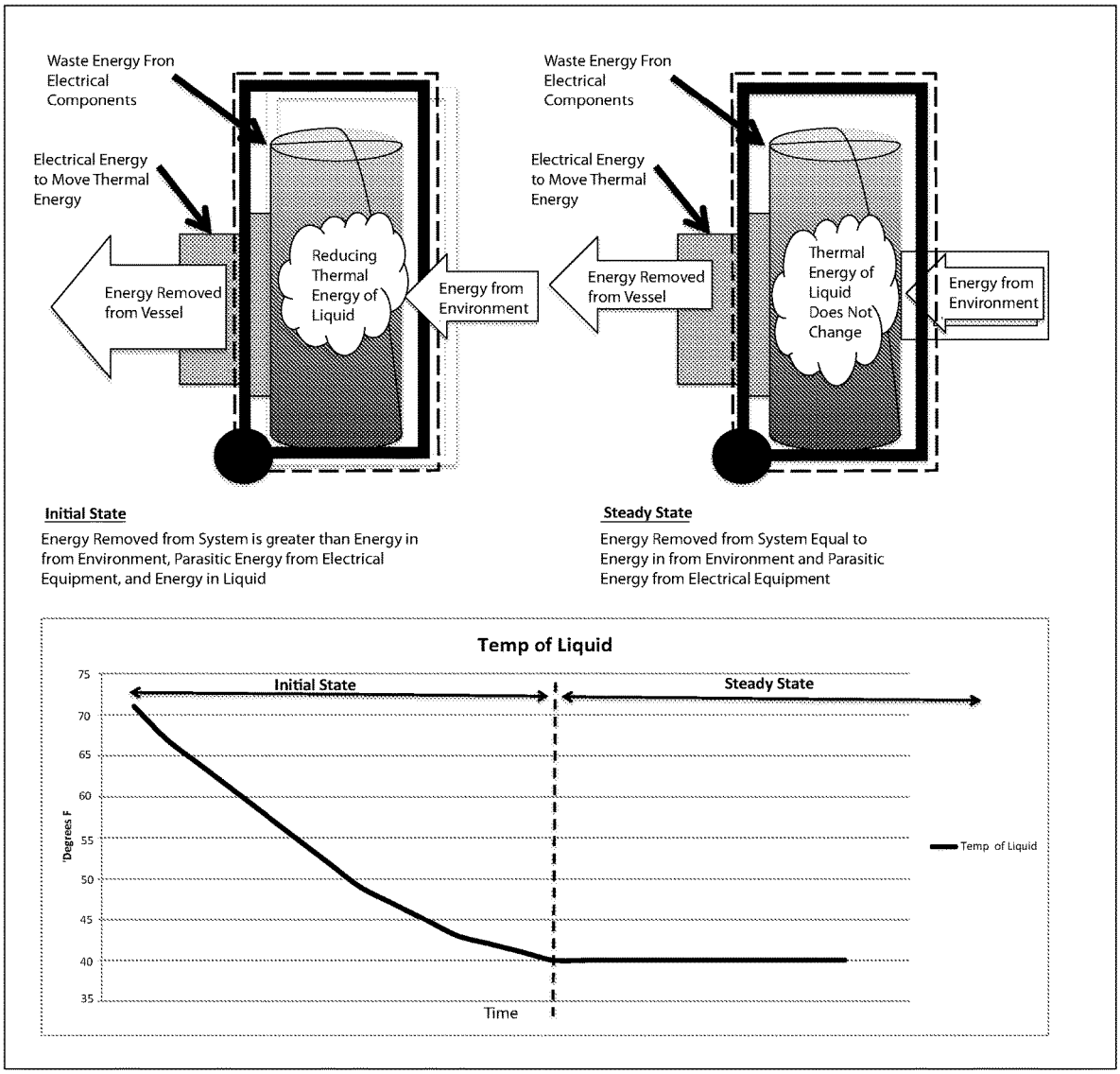
FIG. 16 is a graphical representation of the heat transfer and energy usage functioning of the device.
Figure 17:
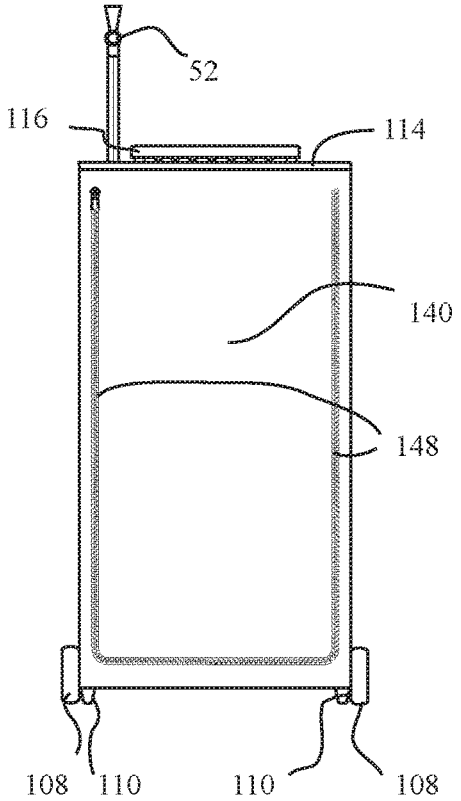
FIG. 17 is a front view of an embodiment of the portable cooler and dispenser showing the exterior and the location of the dispensing bibcock.
Figure 18:
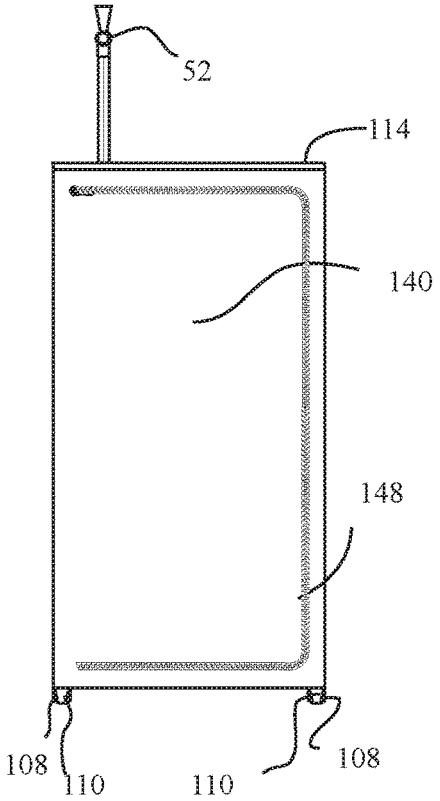
FIG. 18 is a front view of a second embodiment of the portable cooler and dispenser showing the exterior and the location of the dispensing bibcock.
Figure 19:
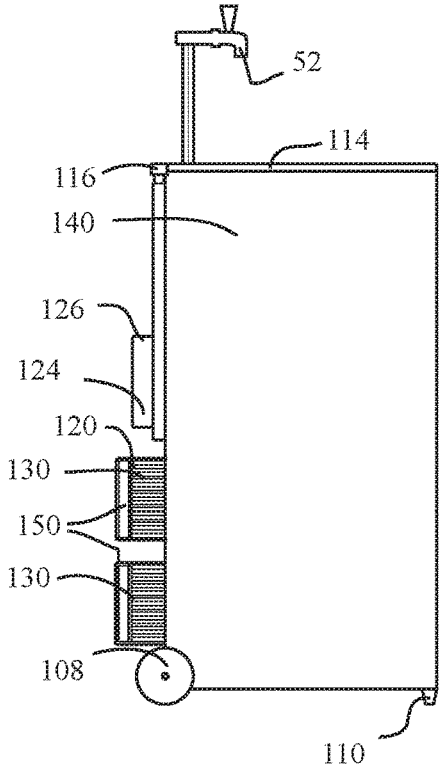
FIG. 19 is a side view of an embodiment of the portable cooler and dispenser showing the exterior and the location of the dispensing bibcock.
Figure 20:
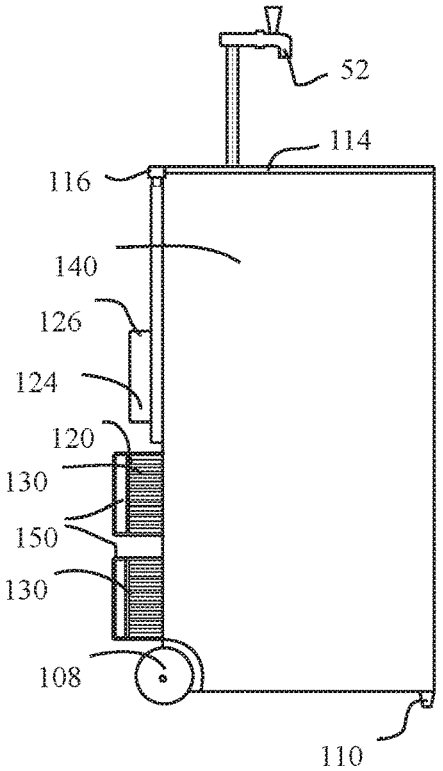
FIG. 20 is a side view of a second embodiment of the portable cooler and dispenser showing the exterior and the location of the dispensing bibcock.
Figure 21:
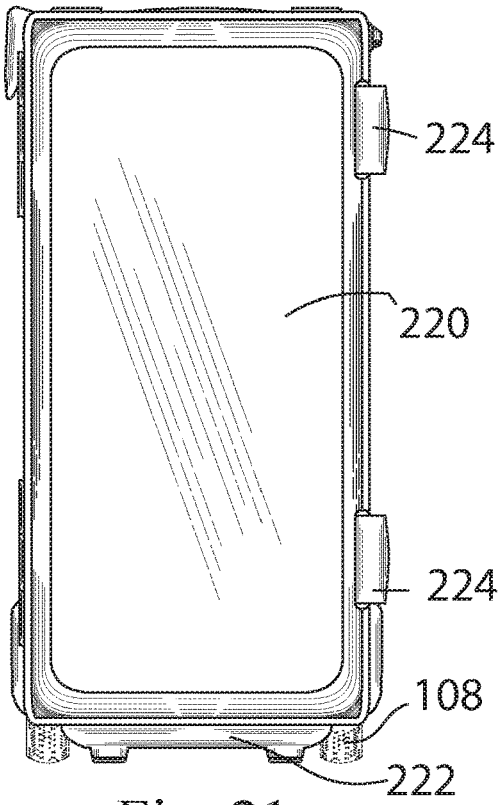
FIG. 21 is a front view of a third embodiment of the portable cooler and dispenser showing the exterior.
Figure 22:
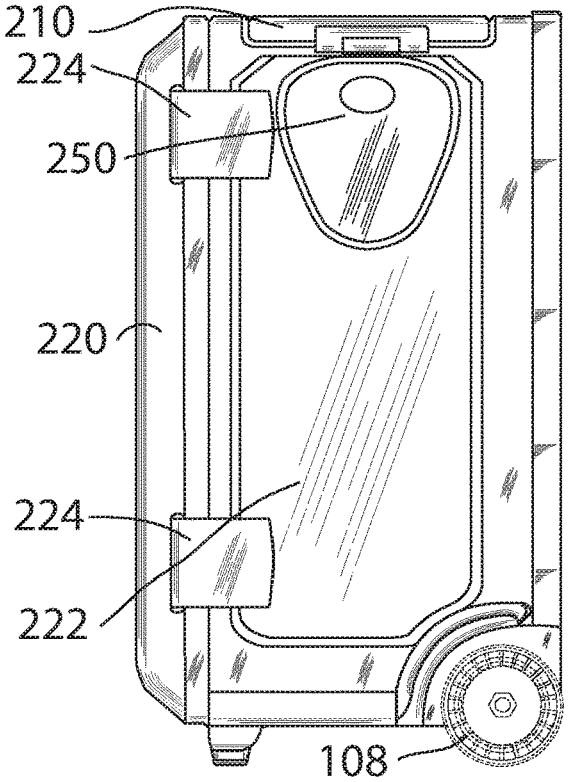
FIG. 22 is a side view of a third embodiment of the portable cooler and dispenser showing the exterior.
Figure 23:
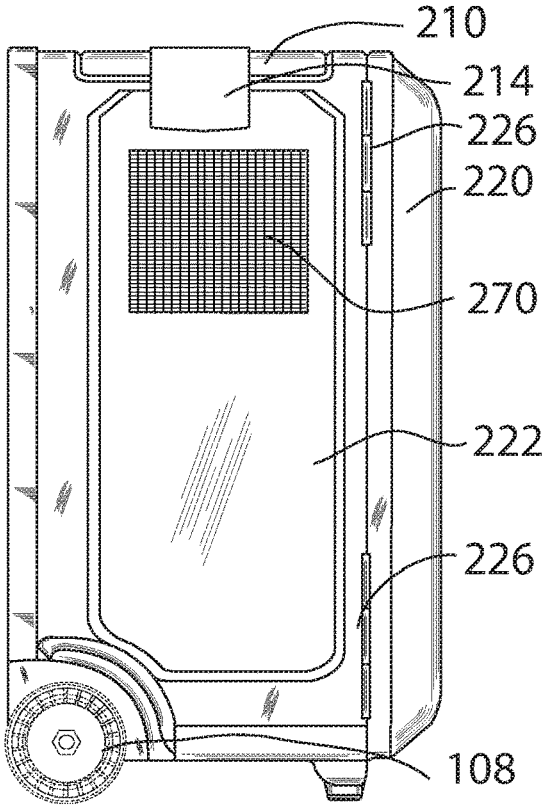
FIG. 23 is a side view of a third embodiment of the portable cooler and dispenser showing the exterior.
Figure 24:
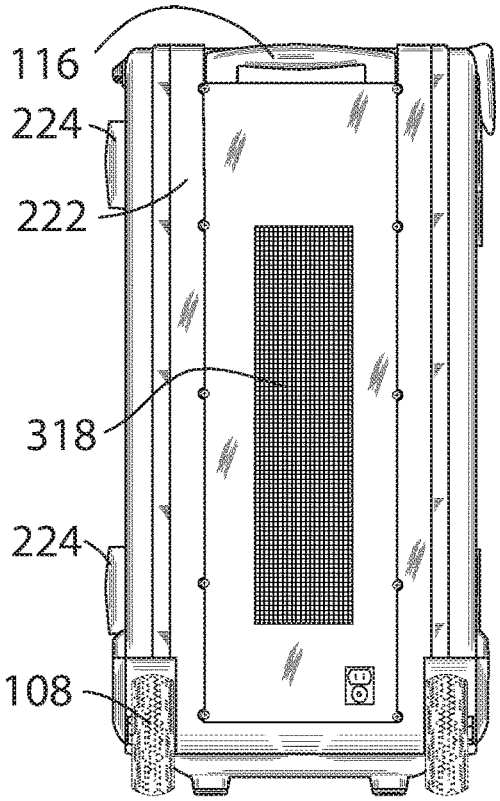
FIG. 24 is a back view of a third embodiment of the portable cooler and dispenser showing the exterior.
Figure 25:
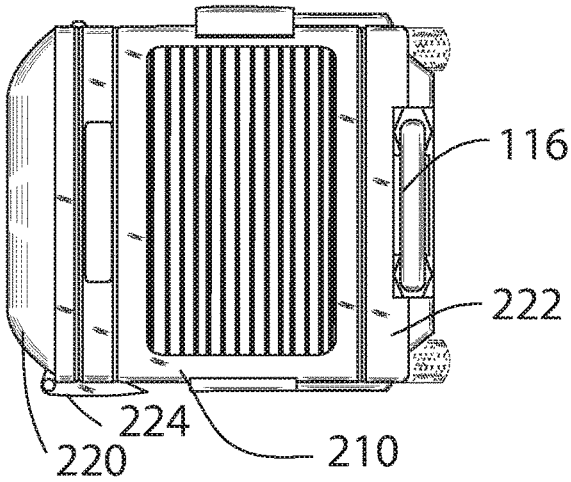
FIG. 25 is a top view of a third embodiment of the portable cooler and dispenser showing the exterior.
Figure 26:
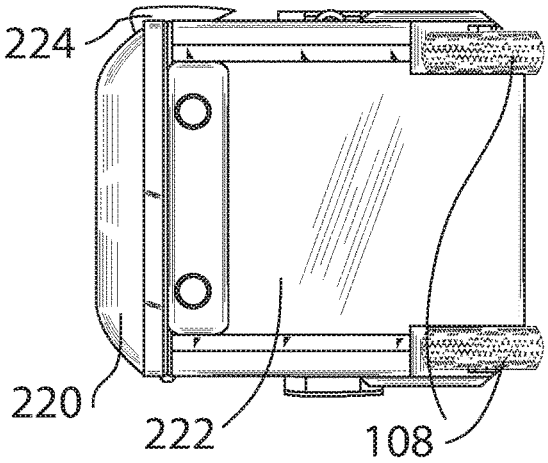
FIG. 26 is a bottom view of a third embodiment of the portable cooler and dispenser showing the exterior.
Figure 27:
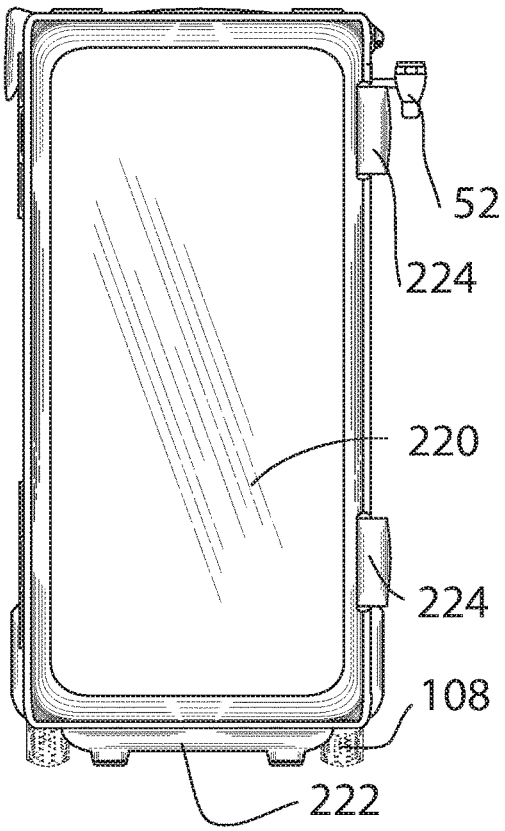
FIG. 27 is a front view of a third embodiment of the portable cooler and dispenser showing the exterior and the location of the dispensing bibcock.
Figure 28:
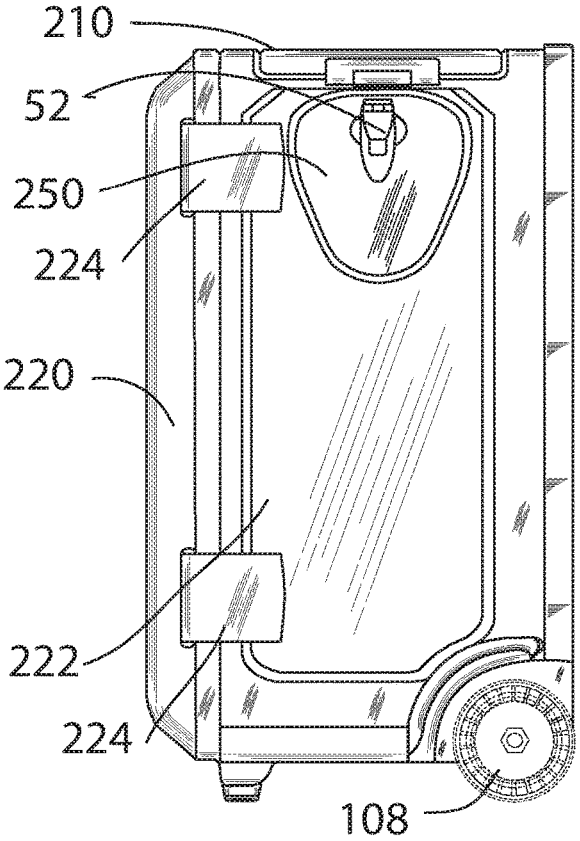
FIG. 28 is a side view of a third embodiment of the portable cooler and dispenser showing the exterior and the location of the dispensing bibcock.
Figure 29:
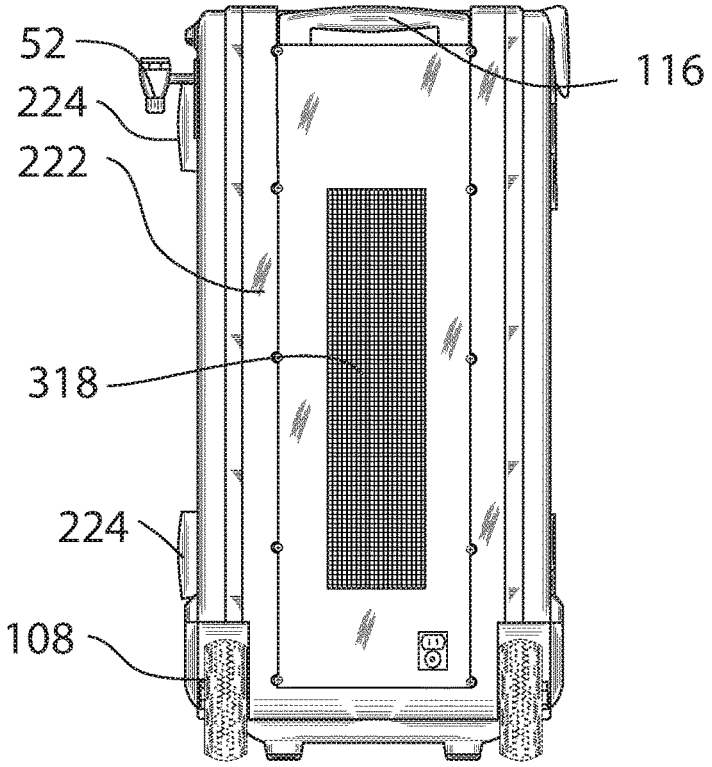
FIG. 29 is a back view of a third embodiment of the portable cooler and dispenser showing the exterior and the location of the dispensing bibcock.
Figure 30:
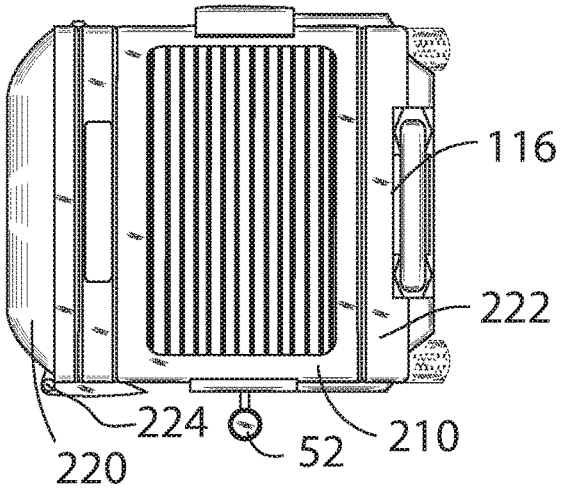
FIG. 30 is a top view of a third embodiment of the portable cooler and dispenser showing the exterior and the location of the dispensing bibcock.
Figure 31:
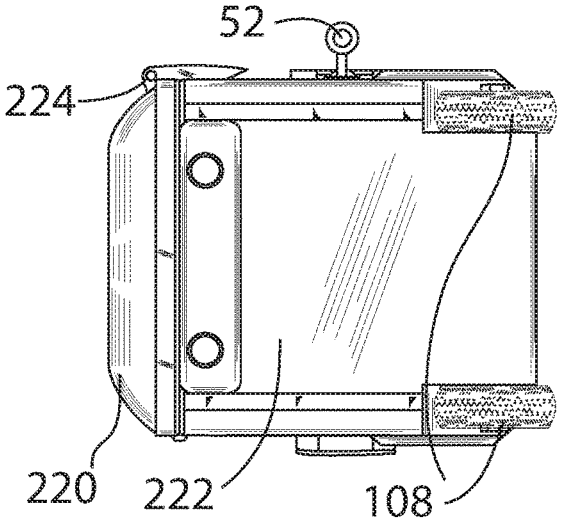
FIG. 31 is a bottom view of a third embodiment of the portable cooler and dispenser showing the exterior and the location of the dispensing bibcock.

The device heat transfer and energy usage is illustrated in FIG. 16. The two stages are the initial state where the ambient temperature Cornelius keg is installed in the device and the refrigeration is reducing the temperature of the liquid, and the steady state where the liquid temperature is at a desired temperature and the refrigeration is maintaining the liquid at that temperature, which requires less energy.

Figure 32:
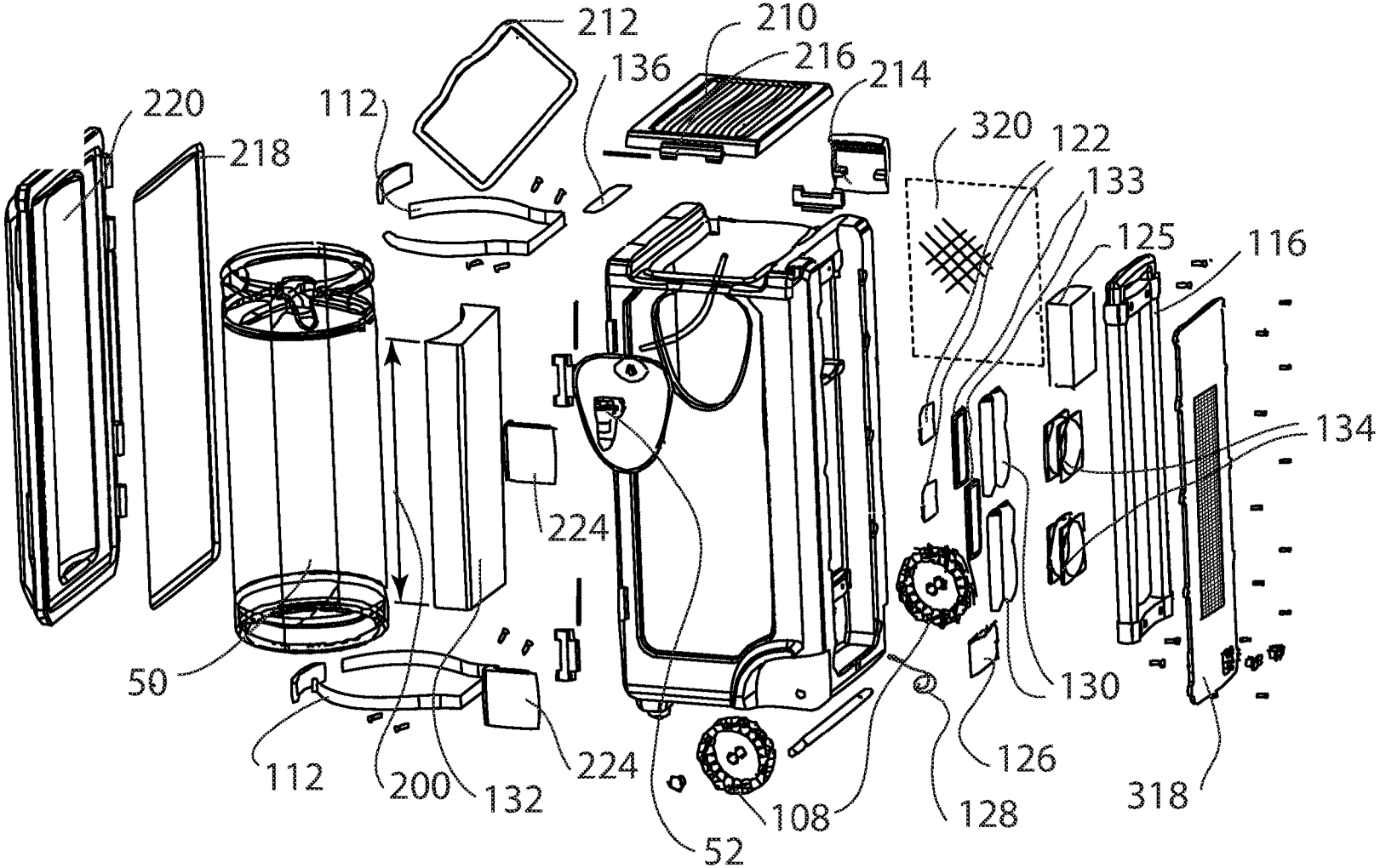
FIG. 32 is an exploded view of a third embodiment of the portable cooler and dispenser representing the arrangement of the major exterior and interior parts.

An embodiment which differs from those described previous by employing a unitary frame and body is shown in FIGS. 21 through 32. The body (222) is closed by a door (220) that has hinges on one side (226) and a latch (224) on the other. A top cover (210) with a seal (212) closes an opening in the top of the body and has a hinge (216) on one side and is secured with a lock (214) on the other. The body (222), door (220), and top cover (210) are double wall polymer with foam insulation installed between the walls instead of the insulation features described previous. This embodiment employs other features as described previous, such as the two wheel (108) and two feet (110) with a collapsible handle (116) transport system and refrigeration system employing two thermoelectric coolers (122), heat sinks (130) and fans (134) and a cooling block (132) that is formed of a metal with good thermal conductivity (example aluminum) to be flat on the side contacting the thermoelectric cooler (122) and concave with a radius selected to fit the contour of the Cornelius keg, as shown in FIG. 11, to provide a cool surface in contact with the anchored keg. The contact of the contour with the keg extends from near the top almost to the bottom encompassing the effective height of the keg as shown in FIG. 32. A protective cover (318) on the rear of the body (222) protects the components of the refrigeration system.

Operation

The device is readied for cooling or transport by installing a Cornelius keg (50) into the device interior. This is done by opening the exterior covering (140) access opening (148), which is shown in FIGS. 1 and 2 and 16 and 17. Then the second insulation member closure (166), shown in FIG. 11, is opened. This provides access to allow inserting the keg (50) within the second insulation member (162). The embodiment with the unitized body requires opening the door (220) to insert the keg (50). The Cornelius keg is secured to the cooling block (132) using the hold-down straps (112). The second insulation member closure (166) is then closed, surrounding the keg (50) with the second insulation member (162), or the door (220). The refrigeration system (120) may then be placed in service by connecting a power cord, which is not shown, to the power supply (124). The temperature control (126), if present, may then be used to adjust the desired temperature of the keg (50).

Transport of the keg is done by tilting the device so it is supported by the wheels only and thus may be rolled on the two wheels. The handle may be used to aid in supporting the device on the wheels.

The dispensing system has provision to be located in storage pockets (146), as shown in FIG. 11, during transport to prevent damage. The embodiment with a unitary body has a mesh pouch (320) providing storage. This system is a bibcock (52) and a pressurization device (54) such as a $CO_2$ cartridge or hand air pump and connecting tubing. The dispensing system is connected to the Cornelius keg (50) when dispensing of the keg contents is desired.

The process for dispensing is to open the exterior covering (140) access opening (148), which is shown in FIGS. 1 and 2 and 16 and 17. This provides access to the bibcock (52) and pressurization device (54) located in the storage pockets (146) on the interior of the exterior covering (140). Then open the second insulation member closure (166), shown in FIG. 11. The embodiment with the unitary body has the top cover (210) access opening lifted, which is shown in FIGS. 22, 23, 25, 28, 30 and 32. This provides access to the Cornelius keg (50) stored in the device. The pressurization device (54) is then removed from the storage pocket (146) or mesh pouch (320) and connected to the keg using the quick disconnect fitting on the device connecting hose. The bibcock (52) is then removed from the storage pocket (146) or mesh pouch (320). The bibcock then may be inserted through the bibcock opening (118) and connected to the keg (50), or the bibcock mounting cover is removed for connection using flexible tubing. This places the device in the configuration shown in FIGS. 16 through 19, and 27 through 31, to allow dispensing the liquid into a glass or other container external to the cooler and dispenser. The pressurization device (54) is connected at the top of the keg, which is open to the interior of the device as shown in FIG. 12. The keg may then be pressurized by opening the $CO_2$ cartridge valve or using the hand pump, and the dispensing system is then in service.

Those skilled in the art will recognize that a wide variety of modifications, alterations, and combinations can be made with respect to the above described embodiments without departing from the spirit and scope of the invention, and that such modifications, alterations, and combinations are not intended to limit the invention, but rather are to be viewed as being within the scope of the invention as claimed.

We claim:

1. A multi-functional device configured for supporting, cooling, insulating, and dispensing a liquid contained in a Cornelius keg arranged with inlet and outlet ports on an upper end, the device comprising:

a frame arranged to enclose, support, insulate and anchor the Cornelius keg in a vertical orientation;

a refrigeration system comprising a cooling block and two thermoelectric coolers, wherein:

(i) the cooling block is arranged to contact the Cornelius keg from near a top to near a bottom of an effective height of the keg, and (ii) the cooling block is further arranged with a concave contact surface with a radius selected to fit a contour of the Cornelius keg;

a controller comprising a temperature sensor, wherein:

(a) the controller is configured to vary a power to the refrigeration system to maintain a temperature based on a temperature setting by a user, and (b) the sensor comprising a wire routed from a location of the controller to a location on a surface of the Cornelius keg, the surface remote from the refrigeration system;

a strap arranged to secure the Cornelius keg to the cooling block and to hold the temperature sensor against the surface of the Cornelius keg; and a first insulating member arranged between the cooling block and the thermoelectric coolers such that a cool side of each thermoelectric cooler is in contact with both the insulation member and the cooling block.

2. The device of claim 1 further comprising a second insulating member and a third insulating member, wherein the second insulating member comprises a wear layer and an insulating layer, the third insulating member comprises a closed cell foam neoprene, and the first insulating member comprises polyethylene bubble film sandwiched between two reflective laminate sheets.

3. The device of claim 1 wherein the frame comprises foam insulation.

4. The device of claim 1 further comprising a first foot, a second foot, a first wheel, and a second wheel are arranged relative to the frame to support the device on a support surface.

5. The device of claim 4 wherein the first and second wheels enable tilting of the device so the first and second feet lose contact with the support surface thereby providing transport of the device on the wheels.

6. The device of claim 5 further comprising a handle coupled to the frame and arranged to assist tilting the device.

7. The device of claim 1 wherein the refrigeration system comprises a power supply.

8. The device of claim 7 wherein an input of the refrigeration system power supply is 110 volt AC or 12 volt DC.

9. The device of claim 8 wherein the refrigeration system includes a temperature display configured to indicate a surface temperature of the Cornelius keg.

10. The device of claim 9 wherein the refrigeration system includes a temperature control having the temperature setting and configured to be adjusted by the user.

11. A cooling system for a Cornelius keg, the system comprising:

a refrigeration system comprising two thermoelectric coolers in contact with a cooling block, wherein:

(i) the cooling block is arranged with a concave surface with a radius selected to fit a contour of the Cornelius keg, and (ii) the cooling block is further arranged to contact the keg from near a top to near a bottom of an effective height of the keg;

a controller comprising a temperature sensor, wherein:

(a) the controller is configured to vary a power to the refrigeration system to maintain a temperature based on a temperature setting by a user, and (b) the sensor comprising a wire routed from a location of the controller to a location on a surface of the Cornelius keg, wherein the surface is remote from the refrigeration system, and wherein the temperature sensor is disposed against the surface of the Cornelius keg; and a first insulating member arranged between the cooling block and the thermoelectric coolers such that a cool side of each thermoelectric cooler is in contact with both the insulation member and the cooling block.

12. The system of claim 11 further comprising a second insulating member and a third insulating member, wherein the second insulating member comprises a wear layer and an insulating layer, the third insulating member comprises a closed cell foam neoprene, and the first insulating member comprises polyethylene bubble film sandwiched between two reflective laminate sheets.

13. The system of claim 11 further comprising an insulating member of foam contained between a double wall polymer.

14. A method of refrigerated storage, transport, and dispensing of a liquid contained in a Cornelius keg, the method comprising:

installing the keg in a device, wherein the device comprises:

a frame arranged to support the keg in a vertical orientation, wherein two wheels and two feet are arranged relative to the frame to enable transport of the keg, and a refrigeration system comprising a cooling block and two thermoelectric coolers, wherein:

(i) the cooling block is arranged to contact the keg from near a top to near a bottom of an effective height of the keg, and (ii) the cooling block is arranged with a concave contact surface with a radius selected to fit a contour of the Cornelius keg;

a controller comprising a temperature sensor, wherein:

(a) the controller is configured to vary a power to the refrigeration system to maintain a temperature based on a temperature setting by a user, and (b) the sensor comprising a wire routed from a location of the controller to a location on a surface of the Cornelius keg, the surface remote from the refrigeration system;

a strap arranged to secure the Cornelius keg to the cooling block and to hold the temperature sensor against the surface of the Cornelius keg; and a first insulating member arranged between the cooling block and the thermoelectric coolers such that a cool side of each thermoelectric cooler is in contact with both the insulation member and the cooling block;

activating the refrigeration system so as to cool the cooling block;

transporting the keg by tilting the frame so the device is rolled on the two wheels;

installing a bibcock on the keg; and dispensing liquid from the keg through the bibcock.

15. The method of claim 14 further comprising a second insulating member and a third insulating member, wherein the second insulating member comprises a wear layer and an insulating layer, the third insulating member comprises a closed cell foam neoprene, and the first insulating member comprises polyethylene bubble film sandwiched between two reflective laminate sheets.

16. The method of claim 14 wherein the frame comprises foam insulation.

17. The method of claim 14 wherein a handle is coupled to the frame and arranged to assist tilting the device.

18. The method of claim 14 wherein an input of the refrigeration system power supply is 110 volt AC or 12 volt DC.

19. The method of claim 14 wherein the refrigeration system includes a temperature display configured to indicate a surface temperature of the Cornelius keg.

20. The method of claim 14 wherein the refrigeration system includes a temperature control having the temperature setting and configured to be adjusted by the user.

* * * * *